US007686714B2

(12) United States Patent
Smith et al.

(10) Patent No.: US 7,686,714 B2
(45) **Date of Patent: *Mar. 30, 2010**

(54) METALLIC ARROW SHAFT WITH FIBER REINFORCED POLYMER CORE

(75) Inventors: Jacob C. Smith, Salt Lake City, UT (US); Edwin A. Rowsell, South Jordan, UT (US); Teddy D. Palomaki, Park City, UT (US)

(73) Assignee: Jas. D. Easton, Inc., Van Nuys, CA (US)

( * ) Notice: Subject to any disclaimer, the term of this patent is extended or adjusted under 35 U.S.C. 154(b) by 520 days.

This patent is subject to a terminal disclaimer.

(21) Appl. No.: 11/246,987

(22) Filed: Oct. 7, 2005

(65) Prior Publication Data

US 2007/0082766 A1 Apr. 12, 2007

(51) Int. Cl.
*F42B 6/04* (2006.01)

(52) U.S. Cl. ..... 473/578

(58) Field of Classification Search ..... 473/578
See application file for complete search history.

(56) References Cited

U.S. PATENT DOCUMENTS

| | | | | |
|---|---|---|---|---|
| 3,277,893 | A | 10/1966 | Clark | |
| 3,401,938 | A | 9/1968 | Bear | |
| 4,203,601 | A | 5/1980 | Simo | |
| 4,533,146 | A | 8/1985 | Schaar | |
| 4,706,965 | A | 11/1987 | Schaar | |
| 4,923,751 | A * | 5/1990 | Bluck et al. | 428/35.9 |
| 4,943,067 | A | 7/1990 | Saunders | |
| 5,035,764 | A | 7/1991 | Blake | |
| 5,090,149 | A | 2/1992 | Young | |
| 5,152,323 | A * | 10/1992 | Shotts et al. | 138/151 |
| 5,207,248 | A * | 5/1993 | Seki et al. | 138/145 |
| 5,242,720 | A | 9/1993 | Blake | |
| 5,273,293 | A | 12/1993 | Lekavich | |
| 5,465,979 | A | 11/1995 | Buhler | |
| 5,496,042 | A | 3/1996 | Craft et al. | |
| 5,516,117 | A | 5/1996 | Rangel | |
| 5,902,199 | A | 5/1999 | Adams, Jr. | |

(Continued)

FOREIGN PATENT DOCUMENTS

GB 2080128 A * 2/1982

OTHER PUBLICATIONS

Beman Products Catalog, 1999.

(Continued)

*Primary Examiner*—John Ricci
(74) *Attorney, Agent, or Firm*—Holland & Hart

(57) ABSTRACT

The present invention is directed to a shaft and arrow system. The shaft and arrow system includes a hybrid structure that may include two concentric tubes. A first of the two concentric tubes may comprise an outer shell or jacket of thin-walled metal alloy. A second of the two concentric tubes may include an inner core of thin-walled fiber reinforced polymer. The two concentric tubes may be bonded together by a suitable adhesive such as epoxy or urethane. The shaft may have a reduced diameter as compared to conventional arrow shafts, and the shaft may be receptive of a variety of inserts, points, nocks, and other components. Some inserts may be completely recessed within a first end of the shaft.

7 Claims, 3 Drawing Sheets

U.S. PATENT DOCUMENTS

| | | | | |
|---|---|---|---|---|
| 5,921,875 | A | 7/1999 | Bickel | |
| 6,017,284 | A | 1/2000 | Giles | |
| 6,241,634 | B1 | 6/2001 | Armer, Jr. | |
| 6,251,036 | B1 | 6/2001 | Wu et al. | |
| 6,274,230 | B1 | 8/2001 | Sarrelongue | |
| 6,520,876 | B1 | 2/2003 | Eastman, II | |
| 6,554,726 | B2 | 4/2003 | Thurber | |
| 6,932,728 | B2 | 8/2005 | Palomaki et al. | |
| 7,077,770 | B2 * | 7/2006 | Palomaki et al. | 473/578 |
| 7,115,055 | B2 * | 10/2006 | Palomaki et al. | 473/578 |
| 2003/0013565 | A1 | 1/2003 | Song | |
| 2003/0073524 | A1 | 4/2003 | Song | |
| 2003/0104884 | A1 | 6/2003 | Eastman, II | |

OTHER PUBLICATIONS

Game Tracker Catalog, 1998.

Advertisement for Easton P/C All-Carbon Hunting Shaft, date unknown.

Easton Bowhunting and Target Archery Guide, 2004, pp. 4-9, 11-13.

* cited by examiner

METALLIC ARROW SHAFT WITH FIBER REINFORCED POLYMER CORE

TECHNICAL FIELD

This invention relates to arrow systems, including in particular hunting and target arrow systems.

BACKGROUND OF THE INVENTION

Many different types of arrows and arrow shafts are known for use in hunting and sport archery. Two arrow types of relatively recent design are the fiber reinforced polymer (FRP) arrows and the aluminum arrows wrapped with fiber reinforced polymer. FRP is a generic term including, but not limited to, fiberglass composites and carbon fiber composites. Aluminum arrow shafts covered with FRP are usually made of an aluminum core covered with carbon fiber and are often referred to as aluminum carbon composite (ACC) arrows, although any FRP may be used as the covering. Traditional FRP and ACC shafts have been produced by a number of different manufacturing processes. The first FRP arrow shafts were constructed with unidirectional reinforcing fibers aligned parallel to the axis of the shaft.

Prior designs and processes for constructing FRP shafts resulted in a low circumferential or hoop strength. The hoop strength of these arrow shafts was so low that the arrows could not withstand even small internal loads applied in a direction radially outward from the center of the shaft. For example, internal loads generated from inserting standard components into the inside of these types of shafts would likely have resulted in failure of the arrow shaft. Arrow components may include, but are not limited to, inserts, points, and nocks.

In an apparent attempt to address the limitations described above, modern FRP arrows with new types of construction have been developed. The typical modern FRP arrows include glass and/or carbon fibers arranged in multiple directions, as opposed to the unidirectional fiber arrangement of the earlier FRP arrows. The multi-directional fiber arrangement (e.g., fibers that run perpendicularly or at an angle relative to each other) increases the hoop strength of the shafts. This allows the shafts to support greater internal loads, including internal loads generated by insert components. Such modern FRP arrows have, however, been traditionally made having an outside diameter and wall thickness of a size sufficient to accommodate standard-sized inserts. These carbon-composite arrows were generally lighter than aluminum shafts, but were generally of the same spine. "Spine" is an industry-standard measurement of arrow shaft stiffness. An arrow must have certain spine characteristics, depending on its length and the draw weight of the archery bow, to achieve proper flight. Generally, the heavier the draw weight, the stiffer the spine (i.e., less deflection) must be. ACC shafts are also generally lighter than standard aluminum arrows of the same spine because they comprise a thin, light core covered with carbon composites.

As a major portion of the archery market has moved toward lighter weight shafts, the modern FRP and ACC arrow have gained widespread acceptance. Lighter arrow shafts have the principal advantage of higher velocities than a heavier arrow when launched from the same bow. Such higher velocities result in a flatter arrow trajectory. The practical advantage of flatter trajectory is that a misjudgment by an archer of the range to a target has less effect on the point of impact.

Nevertheless, FRP and ACC arrows have a number of significant drawbacks. For example, FRP and ACC arrows tend to weld to certain types of targets to some degree. Such "welding" results from the frictional heat generated by the carbon surface of the arrow when it passes into the target. The hot surface of the carbon arrow will soften the epoxy resin at the shaft and melt certain target materials, which will cool shortly thereafter. This makes FRP and ACC arrows difficult to pull from the target. The FRP and ACC arrows may also be damaged as a result of the forces required to remove them from targets. In addition, the FRP sometimes splits at the ends of conventional FRP and ACC arrows.

SUMMARY OF THE INVENTION

One embodiment of the present invention provides an apparatus comprising an arrow shaft. The arrow shaft includes an FRP core and a metallic layer disposed over the FRP core. The metallic layer may comprise an aluminum or metal alloy that covers the FRP core. The FRP core may be substantially the same length as and coterminous with the aluminum alloy. The metallic layer forms a jacket around the FRP core. According to some embodiments, the FRP core comprises an inner diameter of approximately 0.205 inches, and an outer diameter between approximately 0.239 and 0.255 inches. The metallic layer may comprise an inner diameter between approximately 0.241 and 0.257 inches, and an outer diameter between approximately 0.256 and 0.272 inches. According to some embodiments the arrow shaft comprises an inner diameter of no more than approximately 0.205 inches, an outer diameter of no more than approximately 0.272 inches, and a spine of no more than approximately 0.500 inches. Some embodiments include a point (e.g., a field point or broadhead) attached to a first end of the arrow shaft and a nock attached to a second end of the arrow shaft. Some embodiments comprise an insert disposed within the arrow shaft, wherein the arrow shaft comprises a first end wall and the insert is completely disposed below the first end wall and is receptive of a point. Some embodiments include a point threadedly secured to the insert, the point comprising a shoulder bearing directly against the first end wall of the arrow shaft, and a nock attached to a second end of the arrow shaft.

Some embodiments of the present invention comprise an arrow, the arrow comprising a shaft having first and second ends. The shaft also comprises an FRP inner tube, a metallic outer tube concentric with and adhered to the FRP inner tube, a point attached at the first end of the shaft, and a nock attached at the second end of the shaft. The FRP inner tube may comprise carbon, the metallic outer tube may comprise an aluminum alloy, and the FRP inner tube and metallic outer tube may be adhered to one another by an adhesive. According to some embodiments, the adhesive comprises an epoxy, such as a one-part or two-part epoxy. According to some embodiments, the adhesive may comprise urethane. According to some embodiments, the FRP inner tube comprises an inner diameter of approximately 0.2045 inches and an outer diameter between approximately 0.239 and 0.255 inches. The metallic layer may comprise an inner diameter between approximately 0.241 and 0.257 inches and an outer diameter between approximately 0.256 and 0.272 inches. The first end may comprise a first end wall, and the arrow may comprise an insert receptive of the point with the insert disposed below the first end wall.

Another aspect of the present invention provides a hybrid arrow structure. The hybrid arrow structure comprises an inner core having a thin walled tube of carbon fiber composite, an outer shell comprising a thin walled tube of aluminum alloy, and an adhesive bond between the inner core and the outer shell. The hybrid arrow structure has an outer diameter of no more than approximately 0.300 inches. The inner core may comprise an inner diameter of no more than approximately 0.205 inches, and the outer diameter may be no more than approximately 0.272 inches. The carbon fiber composite may comprise unidirectional or angled carbon fibers. The adhesive bond may comprise epoxy, urethane or other adhesives. The hybrid arrow structure may comprise an insert receptive of a point disposed within the inner core, wherein the inner core comprises a first end wall and the insert is completely disposed below the first end wall. The hybrid arrow structure may include a point attached to the insert, the point comprising a shoulder bearing directly against the first end wall of the of the inner core, and a nock attached to a second end of the inner core.

Another aspect of the present invention provides a method of making an arrow shaft. The method comprises providing an FRP tube, placing a metallic jacket over the FRP tube, and adhering the metallic jacket to the FRP tube. The method may further comprise attaching a point and a nock to the FRP tube. Some aspects of the invention may comprise pressing an insert completely into the FRP tube, below an end wall of the FRP tube, attaching a point to the insert, and attaching a nock to the FRP tube.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Figure 1:
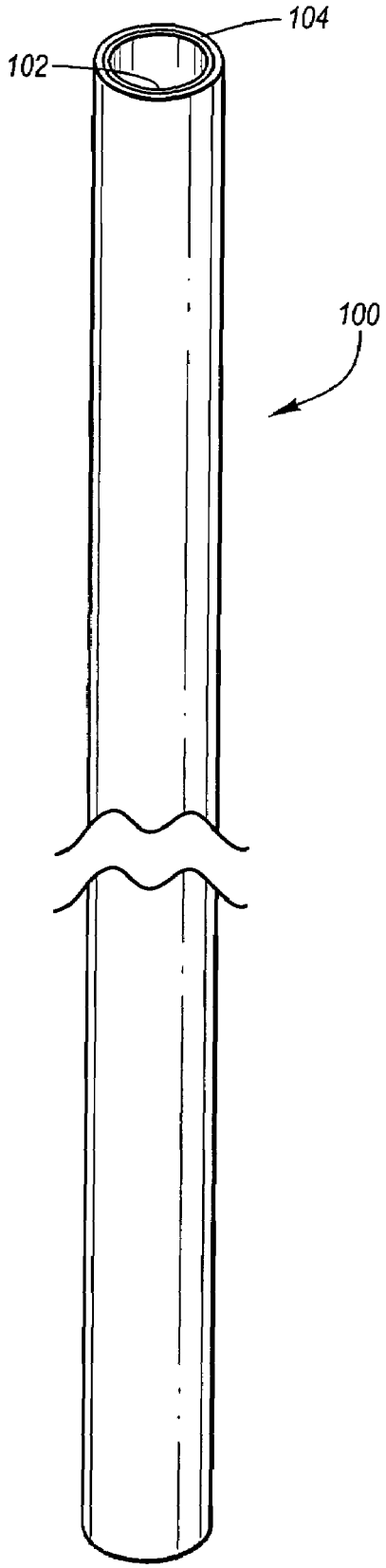
FIG. 1 is a front perspective view of an arrow shaft with an FRP core and a metal jacket or outer layer according to one embodiment of the present invention.

The present specification describes a novel shaft and arrow system that may be used for archery, and particularly for bowhunting and target shooting. One aspect of the novel arrow shaft relates to an arrow with an inner FRP structure, and an outer metal jacket or layer. The outer metal jacket provides resistance to deformation and damage, and provides an arrow shaft structure that is more durable than conventional all-carbon composite designs. The outer metal jacket protects against or resists splitting of the FRP structure. The outer metal jacket may be finished with a camouflage pattern with no additional weight of significance. Shafts made of all-carbon composite, on the other hand, have a weight gain associated with the amount of extra material required to add the camouflage pattern. The hybrid structure disclosed herein with an inner FRP and an outer metal jacket can be straightened to very precise tolerances. In contrast, all-carbon composite arrow shafts are generally sorted to tight straightness tolerances, but they cannot be straightened after assembly.

Another aspect of the novel arrow system relates to a reduced diameter hunting arrow. The reduction in diameter of a hunting arrow facilitates more accurate shooting and better penetration than previous arrows. The reduced diameter hunting arrows may be sized to accommodate standard arrow point assemblies, half-out arrow point assemblies, or smaller diameter arrow point assemblies. The reduced diameter hunting arrow may also be used to accommodate a new point insert system and a new arrow point assembly shown herein, and more fully described in commonly owned U.S. patent application Ser. No. 10/678,821 filed 3 Oct. 2003 (hereby incorporated by this reference) and Ser. No. 10/886,285 filed 7 Jul. 2004 (hereby incorporated by this reference).

Accordingly, the specification describes various aspects of the invention as follows. First, embodiments of an arrow shaft utilizing an FRP core and a metallized jacket are shown and described. Second, embodiments of an arrow utilizing the new point inserts are shown and described. Third, methods of assembling embodiments of the arrow shaft and system are described.

As used in this specification and the appended claims, the term "insert" is used broadly to encompass any apparatus that is or may be at least partially introduced into or inside an arrow shaft. "Hunting arrow" is also used broadly to include any arrows, parts of arrows, or arrow assemblies that are intended specifically for hunting. "Fiber reinforced polymer (FRP)" refers to any combination of materials of which carbon is one, including without limitation fiber reinforced materials, advanced composites, and other material sets that include only carbon. "Spine" is used to indicate a stiffness measurement, as understood by those of ordinary skill in the art. "Point" as used herein means any structure formed at or secured to the forward or distal end of an arrow, including without limitation, field points, broadheads, etc. The words "including" and "having," as used in the specification, including the claims, shall have the same meaning as the word "comprising."

As mentioned above, a number of developments in arrow technology, and particularly hunting arrow technology, have recently occurred. While there are many different types of arrows available, conventional arrows have traditionally not provided the combination of accuracy, flat trajectory, short travel time, penetration, and internal fit components offered by a reduced diameter hunting arrow shaft according to the present invention. Further, conventional carbon composite arrows tend to weld or stick to three-dimensional targets in common use today (predominately made by McKenzie® target company). Pulling conventional carbon composite arrows from targets often requires a force on the order of one hundred pounds. In contrast, standard diameter aluminum arrow shafts will pull from a target at approximately fifty pounds. Nevertheless, traditional aluminum arrows are much heavier and have larger outer diameters than carbon composite arrow shafts. The methods and devices described herein include various diameter arrow shafts and other associated devices that offer many advantages over standard FRP and ACC arrows. The particular implementations, however, are exemplary in nature, and not limiting.

Figure 2:
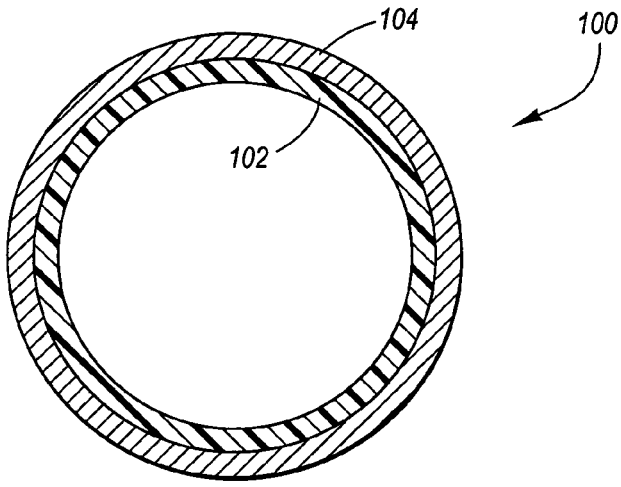
FIG. 2 is a cross-sectional end view of the arrow shaft of FIG. 1 according to one embodiment of the present invention.
Figure 3:
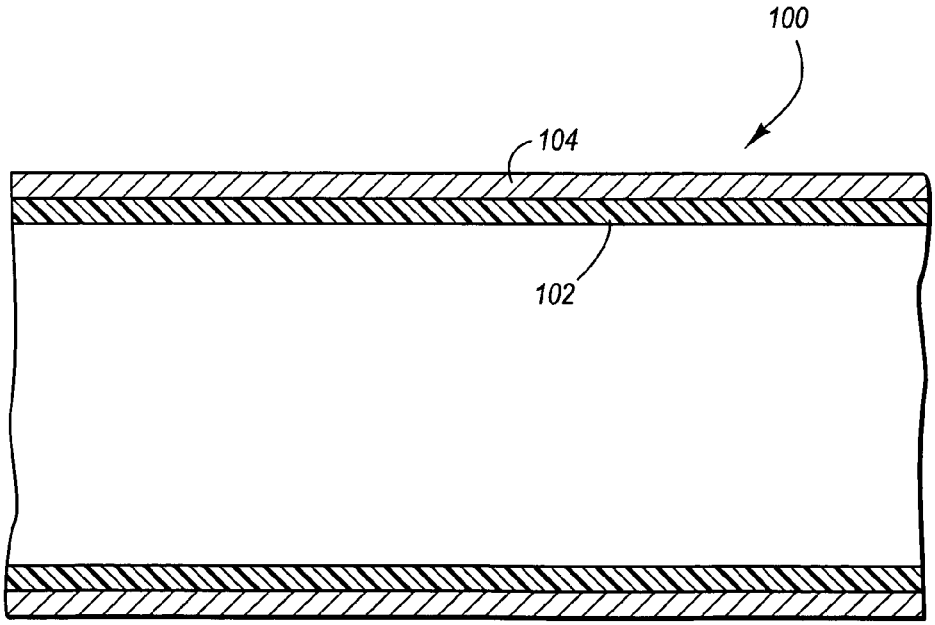
FIG. 3 is a cross-sectional longitudinal view of the arrow shaft of FIG. 1 according to one embodiment of the present invention.

Turning now to the figures, and in particular to FIGS. 1-3, one embodiment of an arrow shaft 100 according to principles of the present invention is shown. The arrow shaft 100 is a hybrid structure of FRP and metal. For example, the arrow shaft 100 may comprise an FRP core, which, according to the embodiment of FIGS. 1-3, is a thin walled inner tube 102. The FRP core may comprise a composite material with carbon fiber reinforcement. However, other types of reinforcing fibers may also be used. The carbon fibers may be arranged unidirectionally or they may be angled (e.g., 75 to 90 degrees) to add hoop strength or other features. A unidirectional arrangement may be less expensive to produce.

As shown in FIGS. 1-3, a metallic layer is disposed over the inner tube 102. The metallic layer may comprise an outer shell or jacket 104. The jacket 104 may comprise an aluminum alloy or another metal or metal alloy. The jacket 104 provides resistance to deformation and damage and provides the hybrid structure with more durability than all-carbon composite shaft designs. The jacket 104 may be finished with a camouflage pattern without adding additional weight. Moreover, the jacket 104 allows the hybrid structure (e.g., a metal jacket in combination with an FRP core) to be precisely straightened following assembly, which is not generally feasible with all-carbon composites. The jacket can be shaped and bent after assembly, and thus the arrow can be straightened. All-carbon composite arrows, on the other hand, cannot generally be straightened after production. Instead, all-carbon composite arrows are produced and then sorted into categories based on straightness. Often the all-carbon arrows are separated into a three-tier straightness system (e.g., good, better, or best, based on predetermined criteria). However, arrows constructed according to principles of the present invention may be straightened following assembly, even if the constituent parts of metal jacket and FRP core are individually not very straight. Therefore, unlike the prior art all-carbon arrows, the number of high quality very straight arrows according to some aspects of the present invention does not depend solely on the natural distribution of arrows produced with various degrees straightness. Accordingly, some methods of the present invention introduce a straightening as a secondary operation after assembly. The straightenable jacket 104 may be adhered to the inner tube 102 by any convenient method. For example, the jacket 104 may be glued to the inner tube 102 with a suitable adhesive such as epoxy or urethane.

According to the embodiment of FIGS. 1-3, the inner tube 102 and the outer jacket 104 are substantially the same length. Moreover, the inner tube 102 and the outer jacket 104 are shown coterminous and flush with one another.

The characteristics of the arrow shaft 100 may be changed from one application to another to meet the needs of various users and applications. For example, Table 1 (below) lists several arrow shaft arrangements of varying spine that may be made according to principles of the present invention.

TABLE 1

| Spine | Weight | FRP Core | | Metal Jacket | | Glue |
|---|---|---|---|---|---|---|
| (in.) | (gpi) | ID (in.) | OD (in.) | ID (in.) | OD (in.) | Gap (in.) |
| 0.300 | 11.6 | 0.205 | 0.255 | 0.257 | 0.272 | 0.001 |
| 0.340 | 11.1 | 0.205 | 0.252 | 0.254 | 0.269 | 0.001 |
| 0.400 | 9.9 | 0.205 | 0.245 | 0.247 | 0.262 | 0.001 |
| 0.500 | 8.9 | 0.205 | 0.239 | 0.241 | 0.256 | 0.001 |

One of ordinary skill in the art having the benefit of this disclosure will, however, understand that the characteristics of Table 1 are merely exemplary in nature. All sets of characteristics are contemplated by the present invention for shafts having an FRP core in a metal jacket.

Nevertheless, there may be certain advantages associated with arrow shaft structures of reduced diameter as disclosed in Table 1. Therefore, hunting arrow shafts may, according to principles described herein, include shafts that have an inside diameter of 0.204 to 0.205 inches to accommodate all standard hunting points currently available. The hunting arrows according to principles described herein may therefore include the advantages of a smaller shaft diameter and the convenience of compatibility with standard hunting points. For example, according to some embodiments of the present invention, there may be arrow shafts having an inside diameter of 0.2045 inches, a spine of 0.500 inches or less, and an outside diameter of less than 0.275 inches. The outside diameter may range, according to some embodiments, between 0.256 and 0.272 inches, depending upon spine. According to some embodiments, the inside diameter is 0.2045 inches, the spine is 0.500 inches or less, and the outside diameter is less than approximately 0.300 inches.

Figure 4:
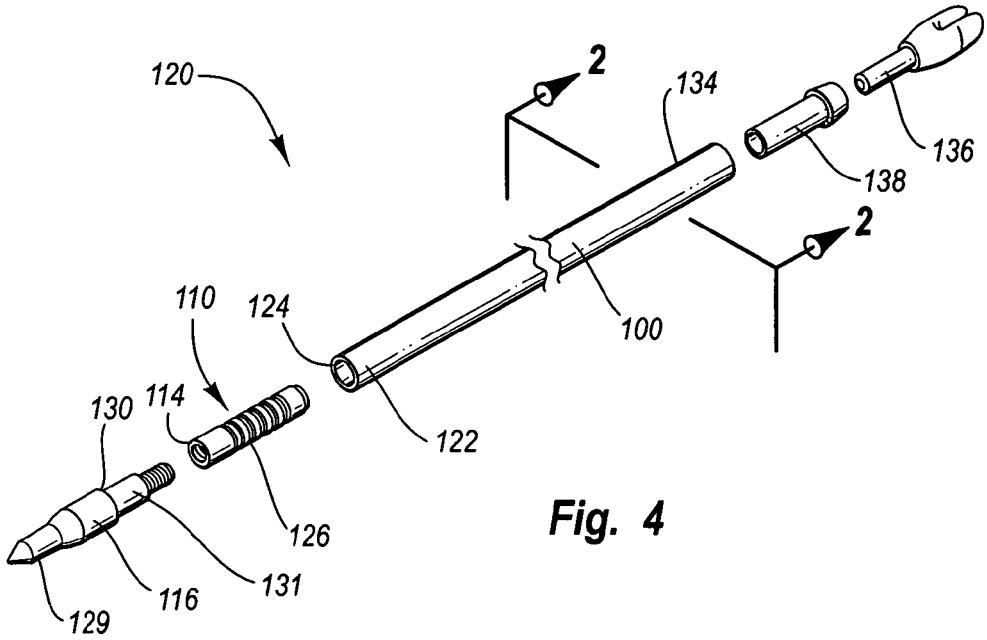
FIG. 4 is a perspective assembly view of an arrow system with an FRP core and a metallized jacket according to one embodiment of the present invention.
Figure 5:
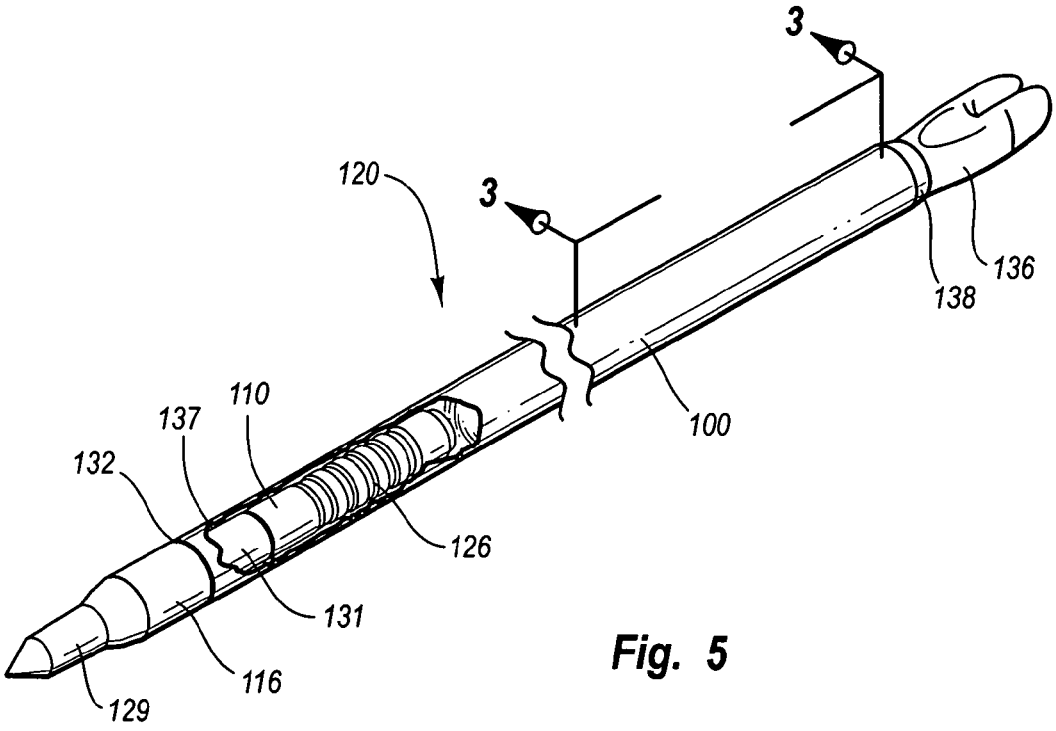
FIG. 5 is a perspective view of the arrow system of FIG. 4 following assembly according to one embodiment of the present invention.

In addition, arrows constructed according to principles of the present invention may be used in combination with novel inserts such as those illustrated in FIGS. 4 and 5. FIGS. 4 and 5 illustrate a hunting arrow 120 according to one embodiment of the present invention. According to FIGS. 4 and 5, the hunting arrow 120 includes the arrow shaft 100 and an insert 110. The insert 110 is receptive of a point 116. The insert 110 is advantageously sized to fit snugly completely within the arrow shaft 100 as shown in FIG. 5. The arrow shaft 100 includes a first end 122 with a first end wall 124. The first end wall 124 of the arrow shaft 100 corresponds to a terminating front end of the shaft 100. The insert 110 also includes a first end wall 114. According to FIGS. 4 and 5, the first end wall 114 of the insert 110 is recessed below the first end wall 124 of the arrow shaft 100 (See FIG. 5). However, the first end wall 114 of the insert 110 may also be flush with the first end wall 124 of the arrow shaft 100. Previous inserts include a lip that prevents disposition completely within or recessed in the arrow shaft 100. The insert 110 of the embodiment shown in FIGS. 4 and 5, however, may be fully embedded and recessed within the arrow shaft 100. Accordingly, the insert 110 may have a substantially constant outside diameter (without regard to conventional glue grooves) sized to fit within an inside diameter of the arrow shaft 100.

The insert 110 may include one or more ridges 126 about its outer diameter, as shown in FIGS. 4 and 5. The ridges 126 do not, however, extend beyond the substantially constant outside diameter of the insert 110 and thus do not prevent full insertion of the insert 110 into the shaft 100. The insert may include a through hole or may have a so-called blind hole in the back wall of the insert (not shown).

The arrow shaft 100 also includes a second end 134 that is receptive of a nock 136. A nock adapting insert 138 may be included between the arrow shaft 100 and the nock 136. Although FIGS. 4 and 5 show such an insert, it is to be understood that any nock system, such as, without limitation, direct fit nock systems, UNI™ bushings with g-nock systems, and PIN nock systems with PIN nocks, may be used without departing from the scope of the present invention. In addition, a plurality of vanes or other fletching (not shown in the drawings) may be secured to the second end 134 of the shaft.

As mentioned above, the insert 110 may be receptive of the point 116. The point 116 is preferably a standard size, commercially available point. The point 116 includes a head 129 and a shoulder 130 where a relatively greater outside diameter of the point 116 transitions to a shank 131. According to principles described herein, the insert 110 has no lip and is inserted to be at least flush with or below the end wall 124 of the arrow shaft 100. Therefore, the shoulder 130 of the point 116 may advantageously bear directly against the end surface 124 of the shaft 100 as shown in FIG. 5. The direct engagement between the shoulder 130 and the end surface 124 according to FIGS. 4 and 5 provides a first direct interface location 132 (FIG. 5) between the end wall 124 of the shaft

100 and the shoulder 130 of point 116 which facilitates a simpler, more precise alignment between the point and the arrow shaft.

The arrow system may also provide a second interface location 137 (FIG. 5) between the arrow shaft 100 and the point 116. Specifically, the outside surface of the shank 131 of point 116 bears directly against the inside surface of the arrow shaft 100.

In contrast, conventional systems provided an extra structural element (i.e., the insert) between the arrow shaft and the point at all locations. Thus, prior art arrow systems provided at least four (4) different sets of interfacing surfaces, all of which have the potential to affect alignment of the respective parts. One set is located between the shoulder of the point and the outer, flat surface of an insert lip. Another is located between the bottom surface of the lip and the end surface of the arrow shaft. Still another set of interfacing surfaces is between the cylindrical outer surface of the standard insert and the inside surface of the arrow shaft. A final set of interfacing surfaces is between the shank on the point and the corresponding inside cylindrical surface of the standard insert.

Thus, arrow systems of the present invention eliminate two of these sets of interfacing surfaces to improve greatly the alignment between the point and the arrow shaft. Specifically, as shown in FIGS. 4 and 5, the present invention provides two sets of direct interfacing surfaces (interfaces 132 and 137) between the arrow shaft 100 and the point 116 to greatly improve alignment. It is to be understood, however, that while some aspects of the present invention are directed to the flush or embedded inserts 110, this particular aspect of the present invention is optional and independent of the arrow shaft 100 structure having an FRP core and a metal jacket.

Arrow shaft diameters may be reduced beyond the dimensions described on Table 1, although they may no longer be compatible with standard points. Instead, the arrow shaft diameters may be sized for half-out inserts. For example, according to some embodiments of the present invention, there may be arrow shafts having an inside diameter of 0.200 inches, a spine of 0.500 inches or less, and an outside diameter of 0.271 inches or less.

In addition to using half-out inserts, the insert 110 of FIGS. 4 and 5 may be specially sized to fit within the 0.200 inch inside diameter shafts. New, specially sized points of a diameter and thread different than standard points currently in use may be needed to engage such a specially sized insert.

Arrows and arrow shafts may be constructed according to principles described herein by providing an FRP tube and jacketing the FRP tube with a metallic tube or jacket. The metallic jacket may be attached to the FRP tube by adding a layer of adhesive to the outside surface of the fiber reinforced tube and/or the inside surface of metallic jacket, and sliding the metallic jacket over the FRP tube. Inserts may be pressed completely within or recessed below an end wall of the arrow shaft. Points and nocks may be added to the ends of the shaft.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention.

What is claimed is:

1. An arrow, comprising:

a shaft having first and second ends, the shaft comprising:

a fiber reinforced polymer inner tube;

a metallic outer tube concentric with and adhered to the fiber reinforced polymer inner tube;

a point attached at the first end of the shaft;

a nock attached at the second end of the shaft wherein the first end comprises a first end wall, and further comprising an insert receptive of the point fully recessed below the first end wall.

2. An apparatus according to claim 1 wherein the metallic outer tube comprises an aluminum alloy jacket covering the fiber reinforced polymer inner tube, and wherein the fiber reinforced polymer inner tube is substantially the same length as the aluminum alloy jacket.

3. An apparatus according to claim 1 wherein the metallic outer tube comprises an aluminum jacket covering the fiber reinforced polymer inner tube, and wherein the fiber reinforced polymer inner tube is substantially the same length as and coterminous with the aluminum jacket.

4. An apparatus according to claim 1 wherein the arrow shaft comprises:

an inner diameter of no more than approximately 0.205 inches;

an outer diameter of no more than approximately 0.272 inches;

a spine of no more than approximately 0.500 inches.

5. An arrow according to claim 1 wherein the fiber reinforced polymer inner tube comprises carbon, the metallic outer tube comprises an aluminum alloy, and the fiber reinforced polymer inner tube and metallic outer tube are adhered to one another by an adhesive.

6. An arrow according to claim 1 wherein the fiber reinforced polymer inner tube comprises carbon, the metallic outer tube comprises an aluminum alloy, and the fiber reinforced polymer inner tube and metallic outer tube are adhered to one another by an epoxy or urethane adhesive.

7. An arrow according to claim 1 wherein:

the fiber reinforced polymer inner tube comprises:

an inner diameter of approximately 0.205 inches;

an outer diameter between approximately 0.239 and 0.255 inches;

the metallic outer tube comprises:

an inner diameter between approximately 0.241 and 0.257 inches;

an outer diameter between approximately 0.256 and 0.272 inches.

* * * * *